US010342374B2

(12) United States Patent
Lancellotti

(10) Patent No.: US 10,342,374 B2
(45) Date of Patent: Jul. 9, 2019

(54) MAILBOX ASSEMBLY

(71) Applicant: Anthony Robert Lancellotti, Harvard, MA (US)

(72) Inventor: Anthony Robert Lancellotti, Harvard, MA (US)

( * ) Notice: Subject to any disclaimer, the term of this patent is extended or adjusted under 35 U.S.C. 154(b) by 20 days.

(21) Appl. No.: 15/802,090

(22) Filed: Nov. 2, 2017

(65) Prior Publication Data

US 2019/0125115 A1 May 2, 2019

(51) Int. Cl.

| | |
|---|---|
| ***A47G 29/12*** | (2006.01) |
| ***G09F 7/10*** | (2006.01) |
| ***G09F 23/00*** | (2006.01) |
| ***A47G 29/122*** | (2006.01) |

(52) U.S. Cl.

CPC ..... *A47G 29/1209* (2013.01); *A47G 29/122* (2013.01); *G09F 7/10* (2013.01); *G09F 23/00* (2013.01)

(58) Field of Classification Search

CPC .. A47G 29/1209; A47G 29/122; A47G 29/30; G09F 7/10; G09F 23/00

USPC ..... 232/38, 17, 45; 40/606.06, 490

See application file for complete search history.

(56) References Cited

U.S. PATENT DOCUMENTS

| | | | | | |
|---|---|---|---|---|---|
| 6,407 | A * | 5/1849 | Allen | G09B 19/02 | 434/209 |
| 1,403,669 | A * | 1/1922 | Chouinard | G03B 15/08 | 352/55 |
| 4,344,244 | A * | 8/1982 | Tyke | G09F 7/02 | 40/490 |
| 4,521,984 | A * | 6/1985 | Murray | G09F 7/10 | 40/490 |
| 4,593,486 | A * | 6/1986 | Visocky | G09F 3/20 | 40/490 |
| 6,708,876 | B1 * | 3/2004 | Shirah | A47G 29/1209 | 232/38 |
| 7,293,696 | B2 * | 11/2007 | Laborde | A47G 29/122 | 232/38 |
| 2010/0073919 | A1 * | 3/2010 | Sharpe | A47G 29/1209 | 362/154 |
| 2018/0103787 | A1 * | 4/2018 | Fonseca | G09F 15/0037 | |

* cited by examiner

*Primary Examiner* — William L Miller

(74) *Attorney, Agent, or Firm* — Dunlap Bennett & Ludwig PLLC

(57) ABSTRACT

A mailbox accessory assembly having novel guide channels for providing interchangeable message panels is provided. The mailbox assembly can be incorporated into a mailbox so that the moving of the mailbox door to a closed condition secures the message panels within the mailbox accessory assembly.

5 Claims, 4 Drawing Sheets

MAILBOX ASSEMBLY

BACKGROUND OF THE INVENTION

The present invention relates to mailboxes and, more particularly, to a mailbox assembly having novel guide channels for providing interchangeable message panels that can be secured therein.

Most mailboxes are a single color and do not allow the owner to express their moods, holidays or the special events in their lives, which of course change from time to time. Furthermore, mailboxes and mailbox accessories do not allow for the display of interchangeable messages or artwork that can be changed at the desire of the owner. Therefore, personalizing mailboxes can take up a significant amount of time, and be difficult to change or just remove when the user no longer wants to express the last message. Moreover, many personalized mailboxes are normally left behind when one moves.

As can be seen, there is a need for mailbox assembly having novel guide channels for providing interchangeable message panels that can be secured therein. The specially designed angle "L" and "T" guides attach to the mailbox allowing a message panel to be removed and replaced in a manner of seconds with no tools, enabling the owner to celebrate holidays and family events on their mailbox with the easy and rapid replacement of the message panels. The message panels can be reused in the future. The present invention contemplates a removable mailbox so that the owner has the ability to employ interchangeable message panels with them if they move to a new location.

SUMMARY OF THE INVENTION

In one aspect of the present invention, a mailbox interchangeable message assembly having two spaced apart L-guides disposed along at least one elongated side of a mailbox; each L-shaped L-guide having a second L-leg, and wherein the two second L-legs are generally coplanar and extend toward each other; a T-guide disposed between the two spaced-apart L-guides; the T-guide having two second T-legs extending in opposing directions and generally coplanar with the second L-legs, and wherein the two L-guides extend from a first end to a second end, wherein the first end provides two voids, one void between each of the two L-guides and the T-guide.

In another aspect of the present invention, a mailbox interchangeable message assembly system providing a mailbox having an opening; a door pivotally connected to the mailbox so as to be movable between an open condition and a closed condition enclosing the opening; at least one mailbox interchangeable message assembly attached to the mailbox so that each first end is just outward of a periphery of the opening; and a side edge of the door extending beyond the periphery of the opening in the closed condition so as to enclose the two voids.

These and other features, aspects and advantages of the present invention will become better understood with reference to the following drawings, description and claims.

DETAILED DESCRIPTION OF THE INVENTION

Figure 1:
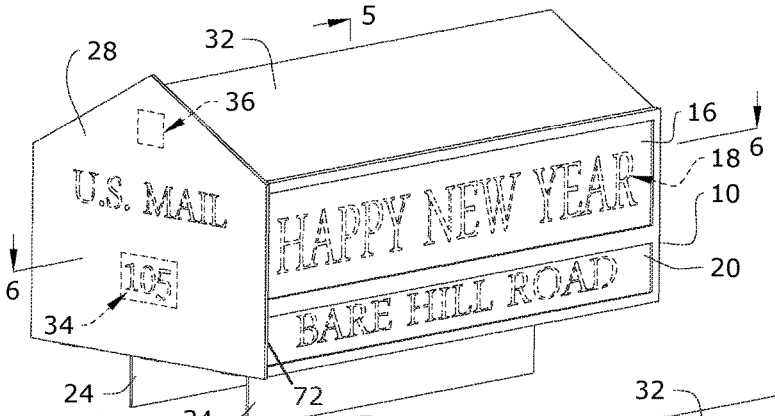
FIG. 1 is a perspective view of an exemplary embodiment of the present invention.
Figure 2:
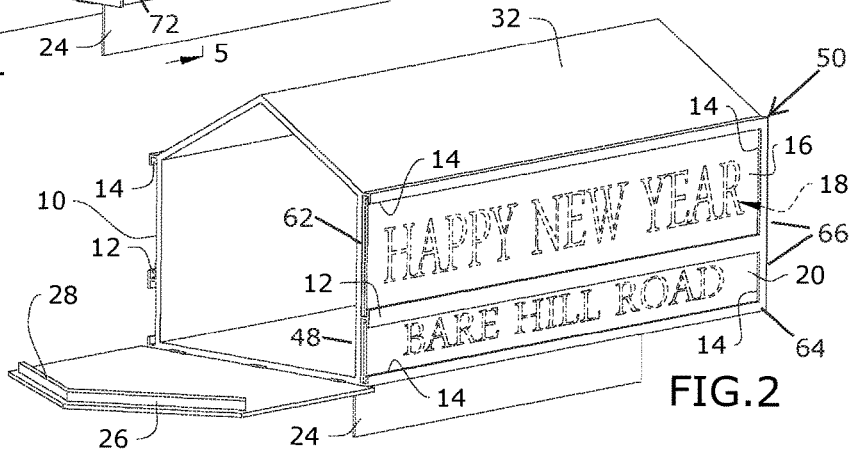
FIG. 2 is a perspective view of an exemplary embodiment of the present invention.
Figure 3:
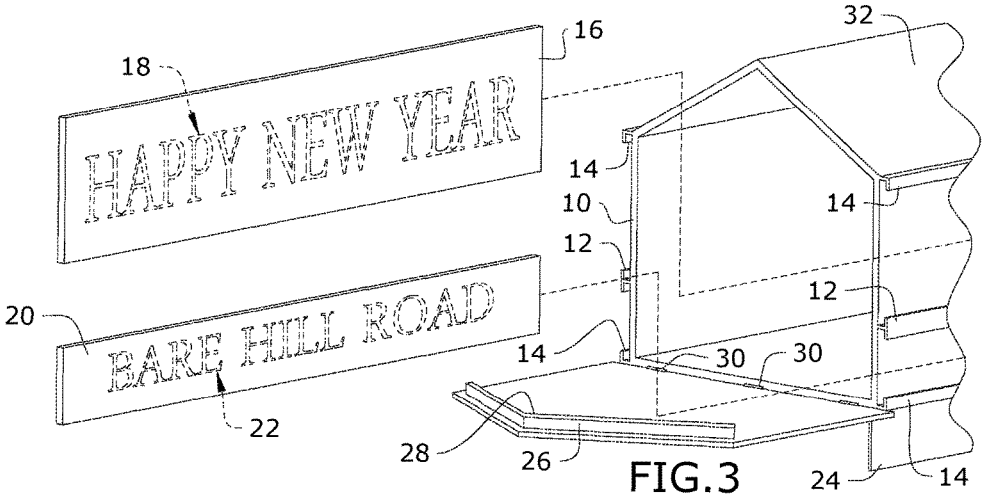
FIG. 3 is an exploded view of an exemplary embodiment of the present invention.
Figure 4:
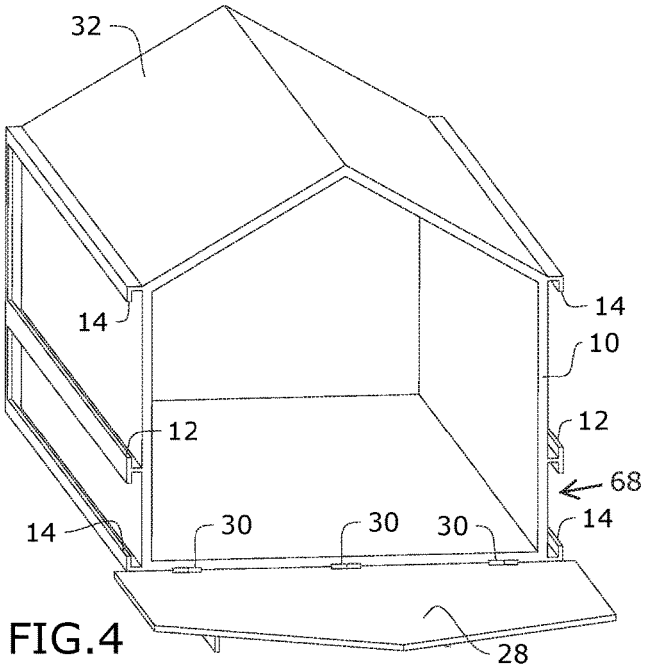
FIG. 4 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a mailbox accessory assembly having novel guide channels for providing interchangeable message panels that can be secured therein. The mailbox assembly can be incorporated into a mailbox so that the moving of the mailbox door to a closed condition thereby securely encloses the message panels therein.

Referring to FIGS. 1 through 15, the present invention may include a mailbox assembly 50 having novel guide channels 12 and 14 for providing interchangeable message panels 16 and 20. The mailbox assembly 50 may be integrated with the mailbox body 10, as illustrated in FIGS. 1-6, or may comprise a detachable mailbox assembly 40 useable for a pre-existing mailbox 38, as illustrated in FIGS. 7-15.

Referring to FIGS. 1 through 6, the present invention may be integrated to the body 10 of a mailbox. The body 10, accordingly, may provide post connection elements 24, such as flanges, typically extending from a lower portion of the body 10. A door 28 may be pivotally connected 30 to the body 10 so that the door 28 can move between an open condition and a closed condition, enclosing an opening 48 communicating with a housing defined by the body 10 for temporarily storing objects, such as letters and other correspondences. A frictional element 26 may be provided on an inner surface of the door 28 just inward of a distal edge thereof. The frictional element 26 may be dimensioned and adapted to frictionally engage an inner surface of the roof 32, thereby providing operative resistance when moving the door 28 from the closed condition to the open condition allowing access to the housing. The door 28 may provide a number region 34 and a logo region along an outer surface thereof.

Figure 5:
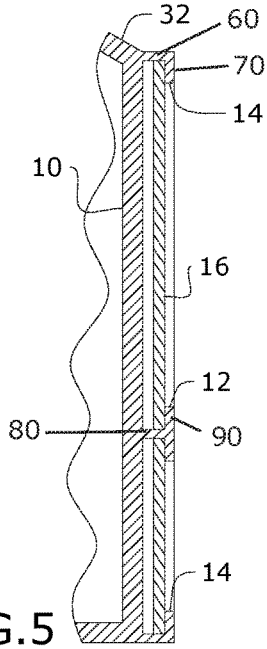
FIG. 5 is a section view of an exemplary embodiment of the present invention, taken along line 5-5 of FIG. 1.
Figure 6:
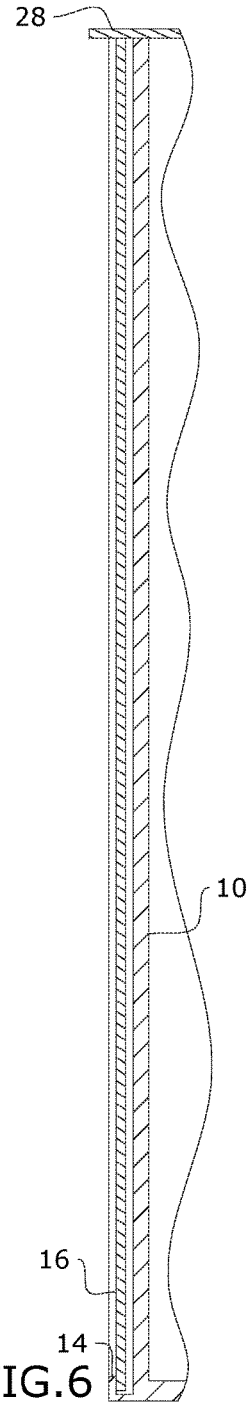
FIG. 6 is a section view of an exemplary embodiment of the present invention, taken along line 6-6 of FIG. 1.
Figure 7:
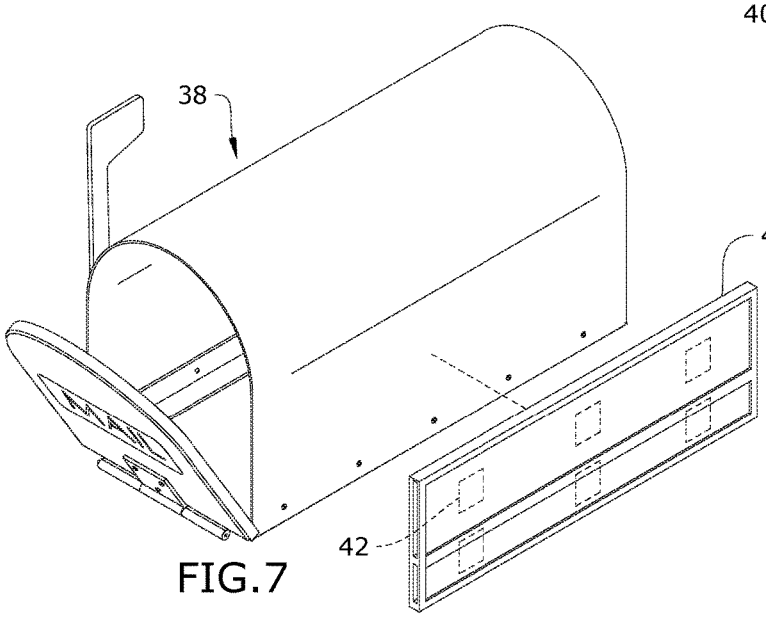
FIG. 7 is an exploded view of an exemplary embodiment of the present invention.
Figure 8:
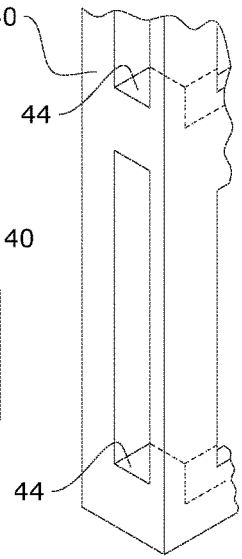
FIG. 8 is an exploded view of an exemplary embodiment of the present invention.
Figure 9:
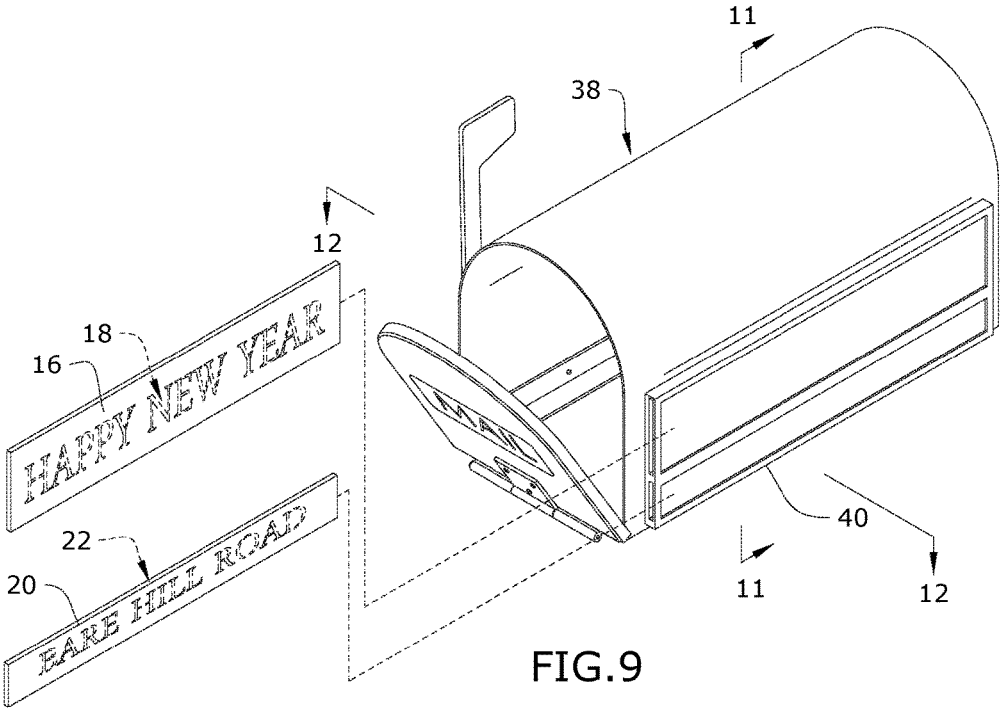
FIG. 9 is a detailed perspective view of an exemplary embodiment of the present invention.
Figure 10:
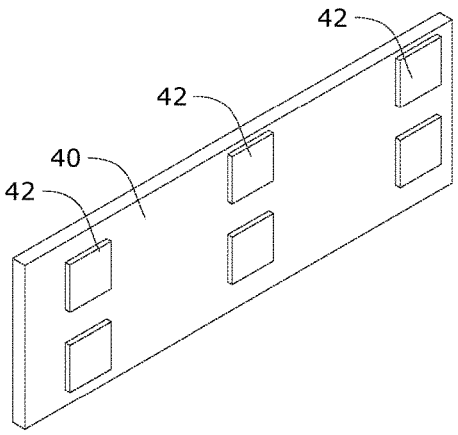
FIG. 10 is a rear perspective view of an exemplary embodiment of the present invention.
Figure 11:
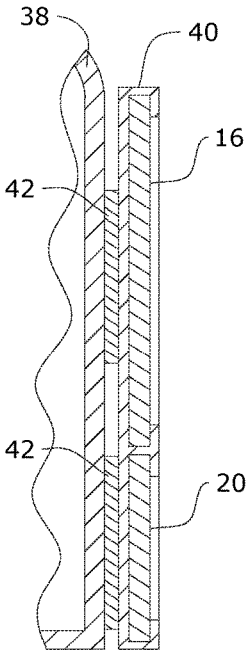
FIG. 11 is a section view of an exemplary embodiment of the present invention, taken along line 11-11 of FIG. 9.
Figure 12:
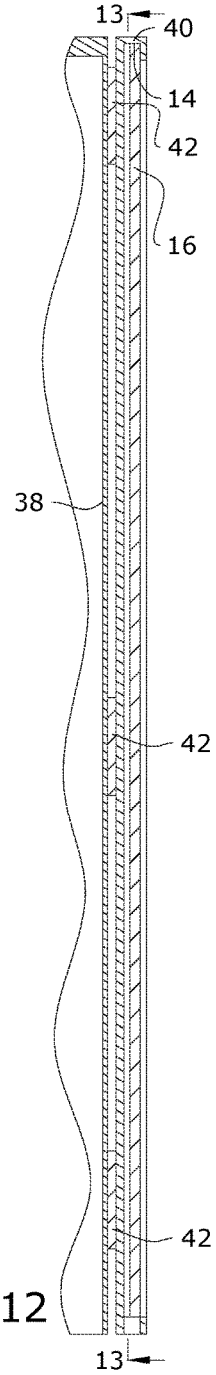
FIG. 12 is a section view of an exemplary embodiment of the present invention, taken along line 12-12 of FIG. 9.
Figure 13:
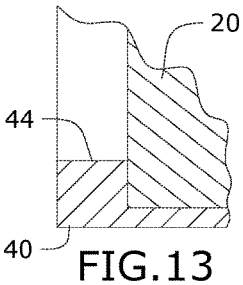
FIG. 13 is a section view of an exemplary embodiment of the present invention, taken along line 13-13 of FIG. 12.

Each mailbox assembly 50 may provide two spaced-apart L-guide channels 14. Each L-guide 14 has a first L-leg 60 and a second L-leg 70, as illustrated in FIG. 5. The two spaced-apart L-guide channels 14 may be oriented so that the distal ends of the respective second L-legs 70 extend toward each other so that a planar insert 16 or 20 may removably slide there between wherein edges of the planar insert 16 or 20 are disposed between the mailbox body 10 and the respective second L-legs 70. Thereby making the planar insert 16 or 20 easy to slide into an operative association with the L-guide channels 14, and easy to slide out for replacement or storage.

In certain embodiments, the mailbox assembly 50 or 40 may include a T-guide channel 12 having has a first T-leg 80 and two opposing second T-legs 90, as illustrated in the FIG. 5. The T-guide channel 12 may be disposed between the two spaced-apart L-guide channels 14 so that the two opposing second T-legs 90, respectively, extend toward the adjacent second L-leg 70, thereby allowing two planar inserts 16 and 20 to slide, one above, and another below, the T-guide channel 12.

The mailbox assembly 50 or 40, may include a first end 62 and a second end 64. The second end 64 may provide a cap element 66, while the first end 62 may provide voids 68 through which the planar inserts 16 or 20 are slid so that the planar inserts 16 and 20 are operatively associated therewith, and wherein the cap element 66 prevents the planar inserts 16 or 20 from sliding out of such association.

The mailbox assembly 50 may be disposed on the elongates sides of the mailbox body 10, as illustrated in FIGS. 1-4, so that the first end voids 68 are just outward of the periphery of the opening 48. The door 28 may have side edges 72 that extend beyond the periphery of the opening 48 so as the enclose the voids 68 when the door 28 is in the closed condition, as illustrated in FIG. 1, thereby preventing removal of the planar insert 16 and 20 through the voids 68. Therefore, if a user were to lock the door 68 in the closed condition, the planar inserts 16 and 20 would not be able to be easily removed or stolen. Each planar insert 16 and 20 may have exemplary messages, 18 and 22 respectively, that conveys customizable messages, such as "Happy Holidays", or the like.

In certain embodiments, the detachable mailbox assembly 40 may have all of the above-mentioned features, and include magnets, adhesive portions or other joining elements 42 for removably attaching the detachable mailbox assembly 40 to a pre-existing mailbox 38. It should be understood that the joining elements 42 may be any joining element known in the art for removably securing one object to another including, for example, standard push-button snaps, Velcro-type fasteners, combinations thereof, and the like. It should also be understood that the joining elements 42 may be configured in any array and/or number, so long as the joining elements 42 function in accordance with the present invention as described herein.

Figure 14:
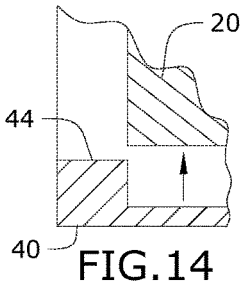
FIG. 14 is a section view of an exemplary embodiment of the present invention, illustrating an insert removal sliding up.
Figure 15:
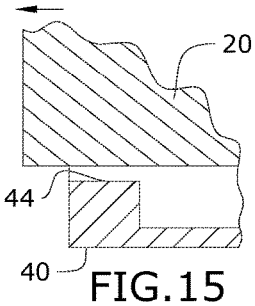
FIG. 15 is a section view of an exemplary embodiment of the present invention, illustrating the insert removal sliding up.

The detachable mailbox assembly 40 may provide a closure element 44 disposed along the lower portion of each void 68. The closure element 44 may be a stop or the like, that prevents the planar inserts 16 and 20 from unintentionally sliding out, thereby securing them in the operative association. Therefore, in certain embodiments, a user needs to lift the insert 16 or 20 prior to removing, as illustrated in FIGS. 14 and 15.

It should be understood by those skilled in the art that the use of directional terms such as inner, outer, inward, outward, lower, and the like are used in relation to the illustrative embodiments as they are depicted in the figures, the inner direction facing the housing shown of the corresponding figures, the outer direction being outside said housing in the corresponding figure, and lower direction associated with the bottom of the figures.

A method of using the present invention may include the following. The mailbox assembly 50 may be provided. A user may slide an insert 16 or 20 with a customizable and/or desired message 18 or 22, respectively, through the void 68, when the door 28 is in the open condition. Then the user may move the door 28 to the closed condition so as to secure the insert 16 or 20 in the operative association displaying the desired message 18 or 20. When a new message is desired, the user may slide the relevant insert out of the void 68 when the door 28 is in the open condition.

For a user using the detachable mailbox assembly 40, the user need first attached it via the side of a pre-existing mailbox 38 via the joining elements 42.

It should be understood, of course, that the foregoing relates to exemplary embodiments of the invention and that modifications may be made without departing from the spirit and scope of the invention as set forth in the following claims.

What is claimed is:

1. A mailbox interchangeable message system, comprising:

a mailbox having an opening;

a door pivotally connected to the mailbox so as to be movable between an open condition and a closed condition enclosing the opening;

at least one mailbox interchangeable message assembly each mailbox interchangeable message assembly comprising:

two spaced apart L-guides, each L-guide having being L-shaped and a second L-leg, and wherein the two second L-legs are generally coplanar and extend toward each other; and wherein the two L-guides extend from a first end to a second end so that the first end provides a void between each of the two L-guides;

each mailbox interchangeable message assembly attached to the mailbox so that each first end is just outward of a periphery of the opening; and a side edge of the door extending beyond the periphery of the opening in the closed condition so as to enclose each void.

2. The mailbox interchangeable message system of claim 1, further providing a cap element closing off the second end.

3. The mailbox interchangeable message system of claim 1, wherein each mailbox interchangeable message assembly further comprises:

a T-guide disposed between the two spaced-apart L-guides; and the T-guide having two second T-legs extending in opposing directions and generally co-planar with the second L-legs so that the first end provides two voids, one void between each of the two L-guides and the T-guide.

4. The mailbox interchangeable message system of claim 3, further comprising at least one message panel; each message panel dimensioned to slide between one of the two spaced-apart L-guides and the T-guide so that a central portion of the message panel is visible between one of the two spaced-apart L-guides and the T-guide, while the opposing edges of the message panel are not visible because of the respective second L-leg and second T-leg.

5. The mailbox interchangeable message assembly of claim 3, further comprising:

a base plate joining the two spaced apart L-guides and the T-guide; and at least one joining element disposed along a surface of the base plate, said surface facing away from the two spaced apart L-guides and the T-guide, whereby the at least one joining element provides a mode for attaching the mailbox interchangeable message assembly to the mailbox.

* * * * *